US006958735B2

(12) United States Patent
Handelsman

(10) Patent No.: US 6,958,735 B2
(45) Date of Patent: Oct. 25, 2005

(54) COMPACT AND EFFICIENT THREE DIMENSIONAL ANTENNAS

(76) Inventor: Dan G. Handelsman, 16 Attitash, Chappaqua, NY (US) 10514

( * ) Notice: Subject to any disclaimer, the term of this patent is extended or adjusted under 35 U.S.C. 154(b) by 81 days.

(21) Appl. No.: 10/615,175

(22) Filed: Jul. 8, 2003

(65) Prior Publication Data

US 2005/0007294 A1 Jan. 13, 2005

(51) Int. Cl.[7] ..... H01Q 11/12
(52) U.S. Cl. ..... 343/742; 343/867; 343/749
(58) Field of Search ..... 343/741, 742, 343/866, 867, 749

(56) References Cited

U.S. PATENT DOCUMENTS 4,358,769 A 11/1982 Tada
5,258,766 A 11/1993 Murdoch
5,442,368 A * 8/1995 Harada et al. ..... 343/713
5,754,142 A * 5/1998 Wine ..... 343/744
5,826,178 A * 10/1998 Owen ..... 455/193.1
5,973,650 A * 10/1999 Nakanishi ..... 343/742
6,259,413 B1 * 7/2001 Schmidt et al. ..... 343/742
6,400,337 B1 6/2002 Handelsman
6,590,543 B1 * 7/2003 Apostolos ..... 343/742
6,600,451 B2 * 7/2003 Mimura et al. ..... 343/741

* cited by examiner

*Primary Examiner*—Tan Ho
(74) *Attorney, Agent, or Firm*—Lilling & Lilling P.C.

(57) ABSTRACT

A volumetrically compact and efficient antenna, with a high radiation resistance and low losses, that can be designed for any frequency, and which has a gain within 1 dB of that of a full-sized vertical monopole radiator or, in its horizontally polarized form, within 2 dB of that of a horizontally polarized half-wave dipole. One embodiment is a rectangle, with short radiators and long interconnecting wires, which has been folded back on itself in a manner that results in a square configuration (when viewed from the top) and brings the two radiating wires into close proximity. Only a single port need be fed. Linear loading sections, such as stubs, serrations and helically wound interconnecting wires can be used to electrically lengthen the antenna, while keeping physical dimensions small. Capacitive loading sections are also used. Two unequal-sized rectangular loops may be joined onto each other, to provide an additional radiating element.

42 Claims, 13 Drawing Sheets

COMPACT AND EFFICIENT THREE DIMENSIONAL ANTENNAS

BACKGROUND OF THE INVENTION

1. Field of the Invention

The present invention relates to antennas. More particularly, it relates to three-dimensional, volumetrically compact antennas of high efficiency. It also relates to compact loop antennas of high efficiency, high gain, and the ability to be tuned over a very wide frequency range.

2. Prior Art

There are various types of antennas that are known in the art. These antennas include the full-wave loop, which can be of any-shaped perimeter from a triangle, square, rectangle, to a polygon with "n"-sides, culminating in a circle. Other such antennas involve operating the above loops at fractions of their resonant frequencies and are therefore small in size with respect to wavelength.

FIG. 1 illustrates one such prior art antenna; a symmetrical octagonal loop 20, which can be full-sized or compact in size depending on the frequency of operation.

Such loop antennas can be fed anywhere on their perimeter, such as at a feed point 22 where the loop 20 is discontinuous. If fed, with respect to ground, at their lower-mid or top-midpoints, the resultant radiation is horizontal in polarization. If fed ninety electrical degrees from either of these points, they are vertically polarized. They may be fed at any other point and the result is mixed polarization.

When these loops are resonant, at a perimeter that is nominally equal to one wavelength, they have radiation resistances (Rrad) in the range of 120 ohms. If, however, such symmetrical loops are operated at frequencies below those where the perimeter is a half-wavelength, they have very low radiation resistance (Rrad) and inductive reactance ($X_L$). These are the most commonly-used compact antennas and are called "Compact Loops" or "Magnetic Loops".

In general the shortcomings of simple Compact Loops, including low radiation resistance and low gain, are well known. Very low feed resistance Rin (the sum of Rrad and Rloss) must be stepped up by various matching networks in order to enable the antenna to be matched to the common 50 ohm standard. The present state-of-the art with respect to such Compact Loops is as follows:

A compact antenna is one that is a small fraction of a wavelength in size. There is no definition of what "compact" means but the most common form of such an antenna is the simple planar circular or octagonal loop having a circumference from 0.03 to over 0.1 wavelength and a diameter of circumference/Π.

These small loops operate on the principle that they are inductive at perimeters which are small fractions of a wavelength. This makes them amenable to tuning to resonance with high-Q capacitors rather than lossy inductors. Capacitors may be used in series with the feed (Cseries) to tune out the inductive reactance. Capacitors may also be used in "T" or gamma matching systems as part of a matching network.

In order to best illustrate the utility of the novel volumetrically compact and efficient antennas embodied in this invention it is necessary to examine in detail the operating parameters of these existing compact loops.

As a basis of comparison, a simple Compact Loop as in FIG. 1, of 1.3 m diameter and with a perimeter of 4.08 m is examined. It is fed at one side that is orthogonal to the ground and is vertically polarized. At a frequency of 7 MHz, the perimeter is just under 0.1 λ. The loop is composed of ¾" or 19 mm thick copper rod, or wire or tubing and is placed 1 meter above "average" ground. All of the loop antennas to be discussed herein are of this size, composed of this diameter rod or wire or tubing and modeled at the same height above ground.

When this loop is modeled, it has a Rin of 0.12 ohms and this is, in turn, composed of a Rloss of 0.05 ohms and a Rrad of 0.07 ohms. The modeled gain is minus 4.51 dBi (−4.51). The input impedance has a reactive component of 156 ohms and this must be tuned out via a capacitor in series with the feedpoint (Cseries).

The above-quoted gain figure involves no losses beyond the copper wire of which it is composed. Due to the extremely low Rrad of 0.07 ohms, the introduction of even 0.1 ohm loss as with a tuning capacitor lowers the gain to −7.1 dBi. Further losses in construction, amounting to only 0.4 ohms (for a total added Rloss of only 0.5 ohm) lowers the gain to −11.6 dBi. An impedance matching network—necessary to step up (500:1) the Rin from fractional ohms to match a source of 50 ohms—can be conservatively estimated to add an additional loss of gain of about 3 dB.

Thus, as discussed in general above, the final gain of this loop can therefore be in the range of −10 to −14.6 dBi depending on the quality of components and construction techniques.

In addition to the low gain the radiation patterns are such that, when operated vertically polarized and near ground level, most of the radiation in the elevation lobe is near the zenith and not near the horizon. The low gains at low radiation angles render these poor antennas for long distance communication on a reliable basis and susceptible to high-arrival-angle interference.

There are other types of loops. As noted above, full-wave loops can be made with any-shaped perimeter. The loop configuration most amenable to the three-dimensional manipulation that results in a volumetrically small antenna is the rectangular loop or rectangle.

FIG. 2 illustrates an antenna in the shape of a rectangle 24, the characteristics of which are such that the fed or radiating wires 26 and 28 need not be the same size as the orthogonal wires 27 and 29 connecting them at their ends. The antenna in FIG. 2 has a pair of vertically oriented radiating elements, with one of the pair being fed at a feed point (not shown). The radiating elements are shorter than the orthogonal wires connecting them. As the radiating wires are made shorter and the length of the orthogonal wires between them increases to maintain a full-wavelength perimeter, the Rrad decreases and the gain increases. The Rrad is proportional to the size of the radiating elements and the gain is a function of the separation between them.

When resonant, such a full-wave loop's currents in its radiating wires are codirectional and in phase with each other and contribute to directivity. Additionally, the interconnecting orthogonal wires, horizontal in the case of the illustration, have out-of-phase currents with the resultant cancellation of radiation in the horizontal plane.

The applicant is aware of three antennas having a superficial similarity in form to the antennas in this application. These are described in:

U.S. Pat. No. 4,358,769, issued to Tada et al., for Loop Antenna Apparatus With Variable Directivity. This antenna is not compact and is composed of a plurality of relatively large loops with a plurality of ports. It is designed to enable changing the directivity and gain to maximize signal strength in the desired direction.

U.S. Pat. No. 5,258,766, was issued to Murdoch or Antenna Structure For Providing A Uniform Field. This antenna is not compact and is not composed of enclosed loops. It is composed of a plurality of partial loops and a plurality of ports and is designed to produce a three-dimensional electric field and involves a complex feed system in order to insure three-dimensional radiation.

U.S. Pat. No. 6,400,337, to Handelsman, the present inventor, for Three-dimensional Polygon Antennas. These antennas consist of a plurality of three or more appended full-wave loops that are arranged three-dimensionally. Each of a plurality of radiating elements is fed from a common source and the design goal is a very large bandwidth; in the order of two or more octaves. These are volumetrically large and function similarly to dipoles of very large diameter. The feed system is the basis for these antennas' bandwidth performance.

SUMMARY OF THE INVENTION

It is an object of the invention to provide a three dimensional compact antenna with only a single port, having the radiation characteristics of a simple dipole.

It is a further object of the invention to fold a single simple loop on itself to render it a three-dimensional compact device, which may be operated just below half of its resonant frequency.

It is another object of the invention to provide an antenna that is physically small yet electrically long and may be operated just below its electrical half-wavelength point.

It is a still another object of the invention to electrically load, by inductive or capacitive means, the wires of the antenna in order to render it volumetrically compact.

It is yet another object of the invention to increase the intrinsic radiation resistance of a compact loop antenna, thus increasing efficiency and gain.

It is a further object of the invention to accomplish these improvements without using a matching network.

These objects and others are achieved in accordance with the invention by an antenna design comprising a single rectangular loop folded into a volumetrically small configuration and which has high-Q loading elements which enable increasing its electrical length at the same time as they serve to reduce its overall size. The antenna is compact in that the length of any side is no longer than 0.025 ② and may be considerably smaller. The utility of this design is that it has a high Rrad and much higher gains than comparably sized Compact Loops. The basis of the design is the creation of a physically small and yet electrically long antenna.

The present invention, in one embodiment, comprises a rectangle, with short radiators and long interconnecting wires, which has been folded back on itself in a manner that results in a square configuration (when viewed from the top) and brings the two radiating wires into close proximity. Only a single port is fed.

The present invention, in another embodiment, comprises the antenna as above but with a plurality of linear loading sections attached to each of the plurality of horizontal sections. This enables significant further decrease in size while retaining the beneficial electrical characteristics of high Rrad, high efficiency and relatively high gain.

The present invention, in another embodiment, comprises the antenna as described above and incorporates a plurality of elements which act as a capacitive loading section at one corner and enables tuning across large frequency bandwidths.

The present invention, in another embodiment, comprises the antenna as described above but with additional linear loading sections attached to its radiating elements. This enables a further reduction in size while maintaining the beneficial electrical properties as noted above.

The present invention, in another embodiment, enables the electrical removal of a pair of linear loading sections in order to allow for matching at an odd-multiple of a half-wavelength of the resonant frequency where the antenna is an electrical open circuit.

The present invention gives rise to a volumetrically compact and efficient antenna, with a high radiation resistance and low losses, that can be designed for any frequency and which has a gain within 1 dB of that of a full-sized vertical monopole radiator or, in its horizontally polarized form, within 2 dB of that of a horizontally polarized half-wave dipole.

The present invention is also directed to a loop within a loop or asymmetric double rectangle antennas, wherein a loop is fitted with an additional radiating element. The additional element may have a capacitive tuning element along its length, and may be fed with a capacitor in series with its feedpoint. The outer loop may be octangonal.

Thus, the present invention also comprises the addition of an extra radiating element in parallel with, and a short distance from, the feedpoint of a small-perimeter compact loop. This radiating element preferably contains a variable capacitor of high-Q at its midpoint. Its utility is greatly enhanced by the advantages of a significant increase in efficiency, a significant increase in radiation resistance, a significant increase in gain relative to a compact loop of the same size and the ability to tune it over a large range in frequency.

This added section enables increasing the effective electrical length of a compact loop of any fractional wavelength perimeter to a perimeter which is slightly less than half a wavelength. This is in line with the design goal of creating physically small yet electrically long loop antennas.

Such an electrical loop length is advantageous since, at frequencies just below the high-impedance half wave point, the radiation resistance (Rrad) is high while the reactance is inductive. The value of the capacitor may be adjusted to attain any value of Rrad that is desired. The inductive reactance may then be tuned out by a high-Q capacitor placed in series with the feedpoint.

The high Rrad, in turn, is intrinsic to the antenna and renders all series losses, whether introduced by the tuning variable capacitors or a function of metal resistivity or less than perfect construction practices, negligible with respect to it. The benefits are a direct match to 50 ohms without the need for a matching network and very high efficiencies and high gains with respect to compact loops of comparable size.

BRIEF DESCRIPTION OF THE DRAWINGS

The foregoing aspects and other features of the present invention are explained in the following description, taken in connection with the accompanying drawings, wherein like reference numeral indicate like components.

DETAILED DESCRIPTION OF THE PREFERRED EMBODIMENT

Figure 1:
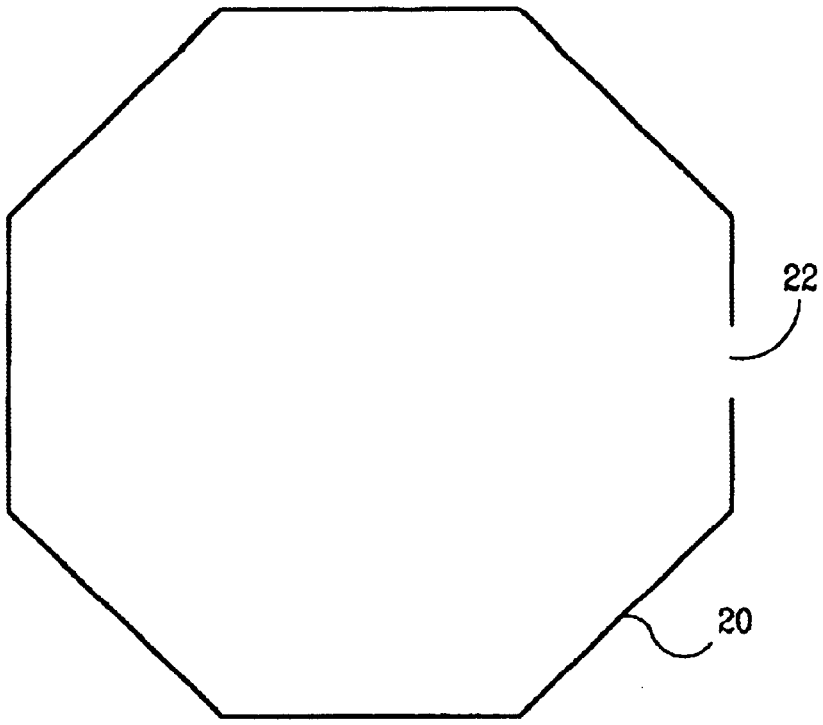
Prior Art FIG. 1
FIG. 1 illustrates a prior art octagonal loop antenna.

The present invention is novel in that it utilizes the follow in g principles to enable the construction of a very volumetrically compact and efficient antenna with a high Rrad and an order-of-magnitude greater gain than that of a Compact Loop.

A. Utilization of an overall electrical length of a rectangular loop which, when operating at slightly below the half-wavelength frequency, results in a high radiation resistance and a high inductive reactance. The Rrad allows for lower antenna currents, lower losses and a match at the commonly-used transmitting/receiving device load resistance standard of 50 ohms. Due to the low loss (Rloss) the Rin is not much higher than the Rad. The high inductive reactance allows for tuning out the reactance with a low-value capacitance, high-Q, low-loss capacitor in series with the feed point.

B. The three-dimensional folding of a planar rectangular loop, as above, into one of four sides in order to reduce the overall maximum dimension. This brings the radiating elements into close proximity and results in a radiation pattern characteristic of a dipole.

C. The inductive loading of each of the sections connecting the two radiators to maintain the electrical length at the optimal point for the targeted Rin while further significantly reducing the dimensions.

D. The addition of a capacitive tuning section at one corner of the antenna which allows for tuning, at the desired Rin, over a large frequency bandwidth.

E. Inductively loading the two radiators in order to allow for a further reduction in size.

F. Electrically removing a pair of inductive loading sections in order to allow for a match at odd-multiples of the half-wavelengths of the resonant frequency.

Modeling Software and Reference Antennas:

The test frequency of all models and prototypes referred to in this application is 7 MHz, unless stated otherwise.

Computer models were generated with NEC-2 (Numerical Electronics Code) and, if buried ground systems were used, the data was generated by a licensed user of NEC-4.

Reference antennas, for gain and pattern comparisons, were full-sized 0.25 λ monopoles over a ground radial system consisting of sixty four buried radial wires for comparisons with vertically polarized antennas. The ground quality, for modeling purposes, is Sommerfeld-Norton (S-N) "average". This ground has a conductivity of 5 mS/meter (milli Siemans/meter) and dielectric constant of 13.

Nominally 0.5 λ resonant dipoles are used for comparisons with horizontally polarized antennas.

Directivity, as expressed in degrees in the vertical or elevation plane, is referenced against the horizon. That is, a takeoff angle (TOA) or elevation angle is expressed as degrees above the horizontal.

Detailed exposition of the design stages summarized above:

Desired Electrical Characteristics:

At the exact frequency at which the loop is a half-wavelength, it is an electrical open circuit with extremely high impedance components, R and X. Below that frequency, the reactance is inductive and the resistance progressively falls to extremely low values at frequencies substantially below this point.

The design endpoint is an Rin of 50 ohms (or any other desired value) which occurs on the down-slope of the resistance curve just below the frequency where the rectangular loop is electrically a half-wavelength in perimeter.

Figure 2:
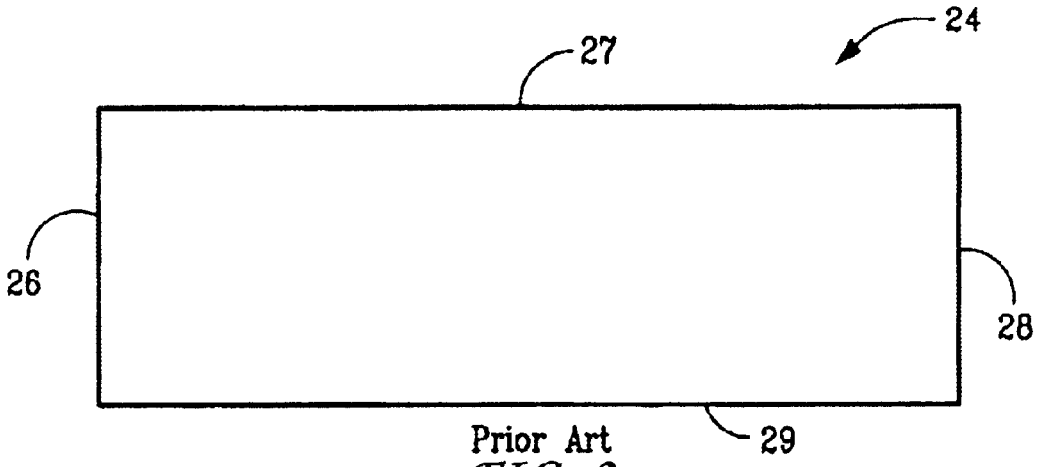
Prior Art FIG. 2
FIG. 2 illustrates a prior art planar rectangular loop antenna.

With a planar rectangle with a height dimension of 1.3 m, as illustrated in FIG. 2, the targeted Rin of 50 ohms at 7 MHz can be attained with a width dimension of 7.6 meters. At this point the reactance (X) is about 2000 ohms. The resonant frequency is 15.5 MHz.

Figure 3:
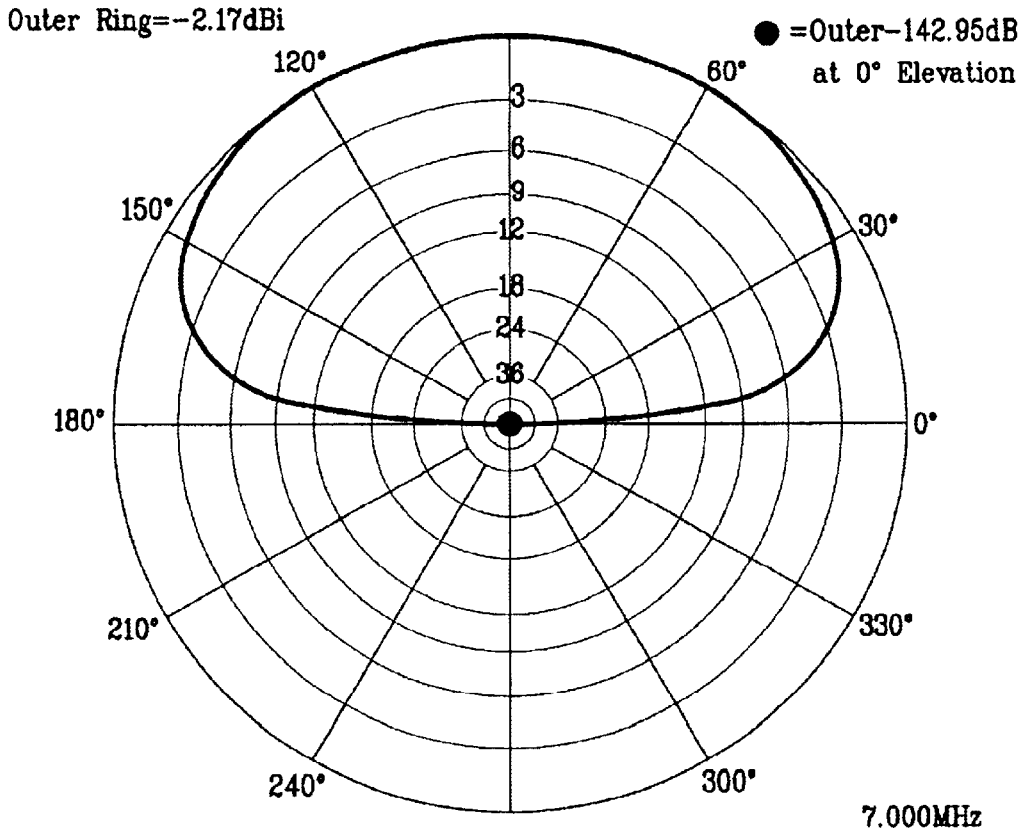
Prior Art FIG. 3
FIG. 3 illustrates t he radiation pattern, in the elevation plane, of the planar rectangular loop antenna of FIG. 2.

When vertically polarized and operated at 1 m above ground level, in common with compact loops, the radiation is end-fire along the plane of the loop and is maximal at a high takeoff angle of 57 degrees. This is shown in FIG. 3.

Reduction in Size by Folding:

The simple rectangle in FIG. 2, with the dimensions noted above, cannot be considered compact. The issue then becomes one of taking such a loop and converting it into a more compact antenna.

Figure 4:
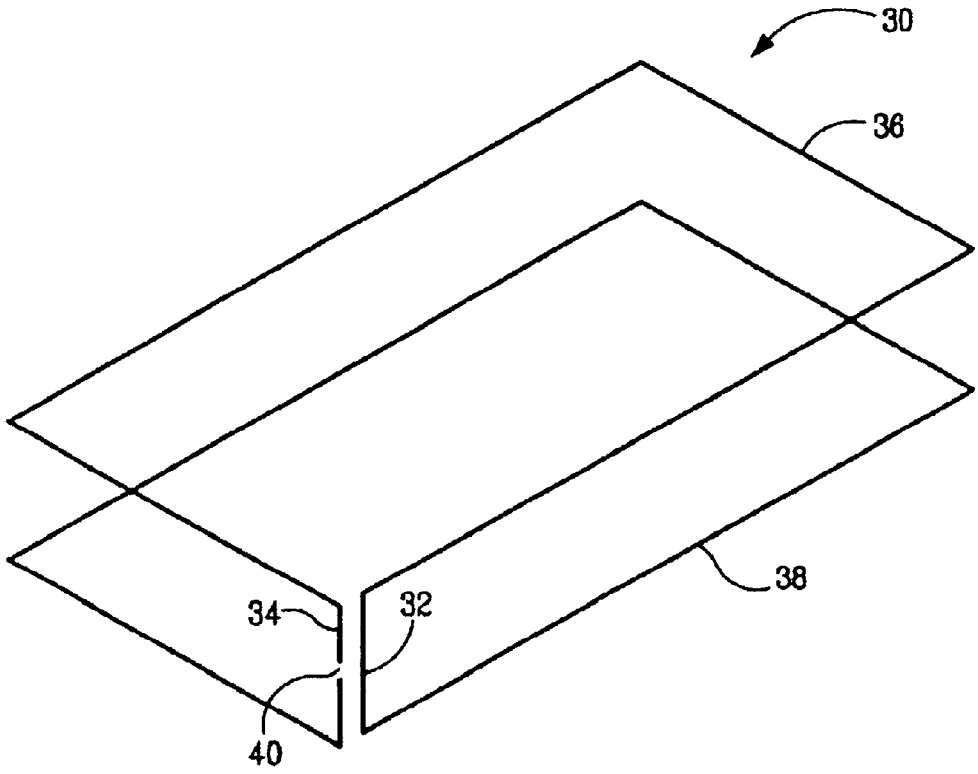
FIG. 4 illustrates a rectangular loop folded in three-dimensions, in accordance with the invention.

FIG. 4 illustrates a novel feature of the present invention. It is the folding of the planar rectangle into a three-dimensional form 30. The two vertical radiating wires 32 and 34 are in close proximity and the horizontal wires 36 and 38 are linear. The antenna is fed at feed point 40, located at the center of the left-most vertical wire in FIG. 4.

The dimensions of this antenna are as follows: The radiator height is 1.3 meters and the total wire length in the horizontal sections is 9.2 m. Each side is therefore about 2.3 m. The "footprint" is a square of 2.3 m/side. Folding the small rectangle back upon itself three-dimensionally accomplishes the objective of decreasing the maximum dimension from 7.6 to 2.3 m, a decrease of approximately 70%.

Radiation Resistance:

An Rrad of 50 ohms can be attained easily at the design frequency of 7 MHz. The Rloss, at an Rin of 50 ohms, is 4.2 ohms. Efficiency is over 90%. The reactance, while inductive and in the order of 3000 ohms, can be tuned out by a low capacitance high-Q capacitor in series with the feed.

Figure 5:
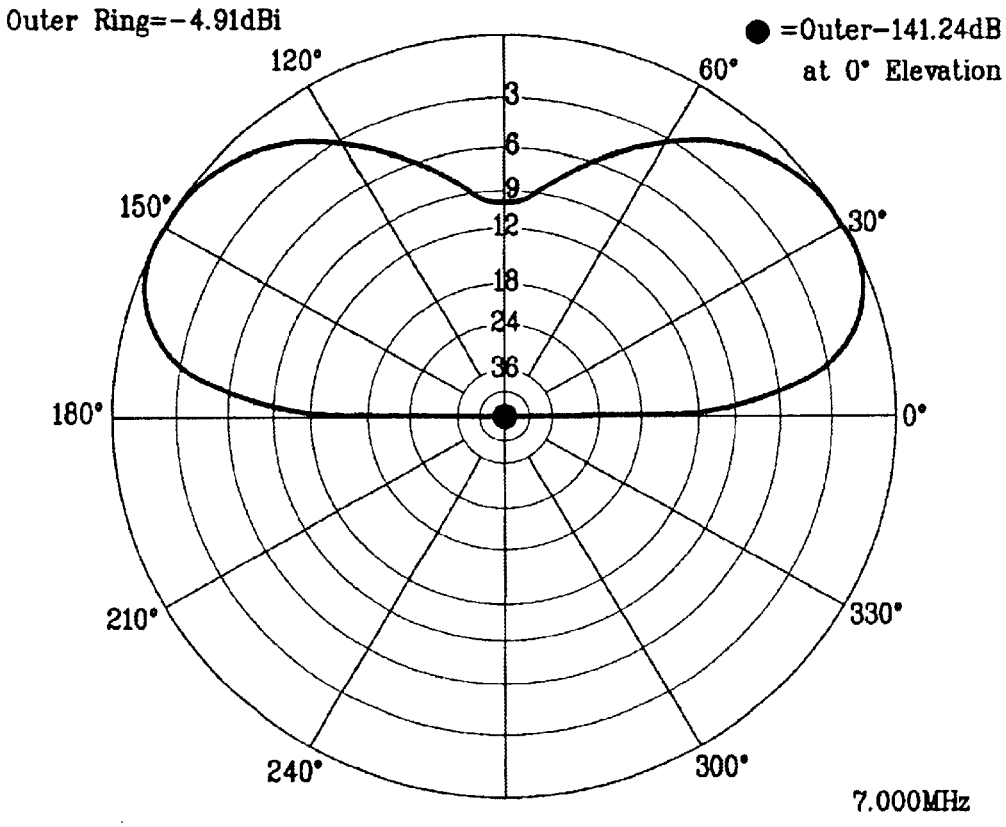
FIG. 5 illustrates the elevation pattern of a folded rectangular loop in accordance with FIG. 4.

Radiation Patterns and Gain:

FIG. 5 illustrates that the gain, 1 meter above a ground and without a ground system, is −4.9 dBi. With the antenna 1 meter above a ground radial system, the gain is −2.3 dBi, at a TOA of 30 degrees where it is maximum, and is circular in the azimuthal plane. Folding a planar rectangle lowers the angle of the elevation lobe of maximum radiation significantly.

Bandwidth:

Due to its small size and high-Q, the operating bandwidth at 7 MHz is 18 KHz.

Further Reduction in Size by Inductive Loading:

The next embodiment of the antenna illustrates how small in all three dimensions this antenna can be constructed while still retaining its beneficial properties. After this step the antenna can truly be called compact.

It was noted that inductive loading, in the form of coils, at the centers of all eight horizontal wires, would electrically lengthen these wires and enable maintaining a Rin of 50 ohms while reducing the overall dimensions. A final size of 1.3 meters in all three dimensions was arrived at by NEC modeling. This is the smallest that would yield an Rin of 50 ohms at 7 MHz and maintain a gain, over a radial system, of within 1 dB of that of the reference monopole. The size is approximately 0.03 λ/side at 7 MHz.

Computer models indicate a significant increase in loss resistance and a decrease in gain unless the inductor Q is 500 or greater. Such high-Q inductors are practically unattainable. Other means of electrical lengthening must be used as substitutes for simple coils.

Figure 6:
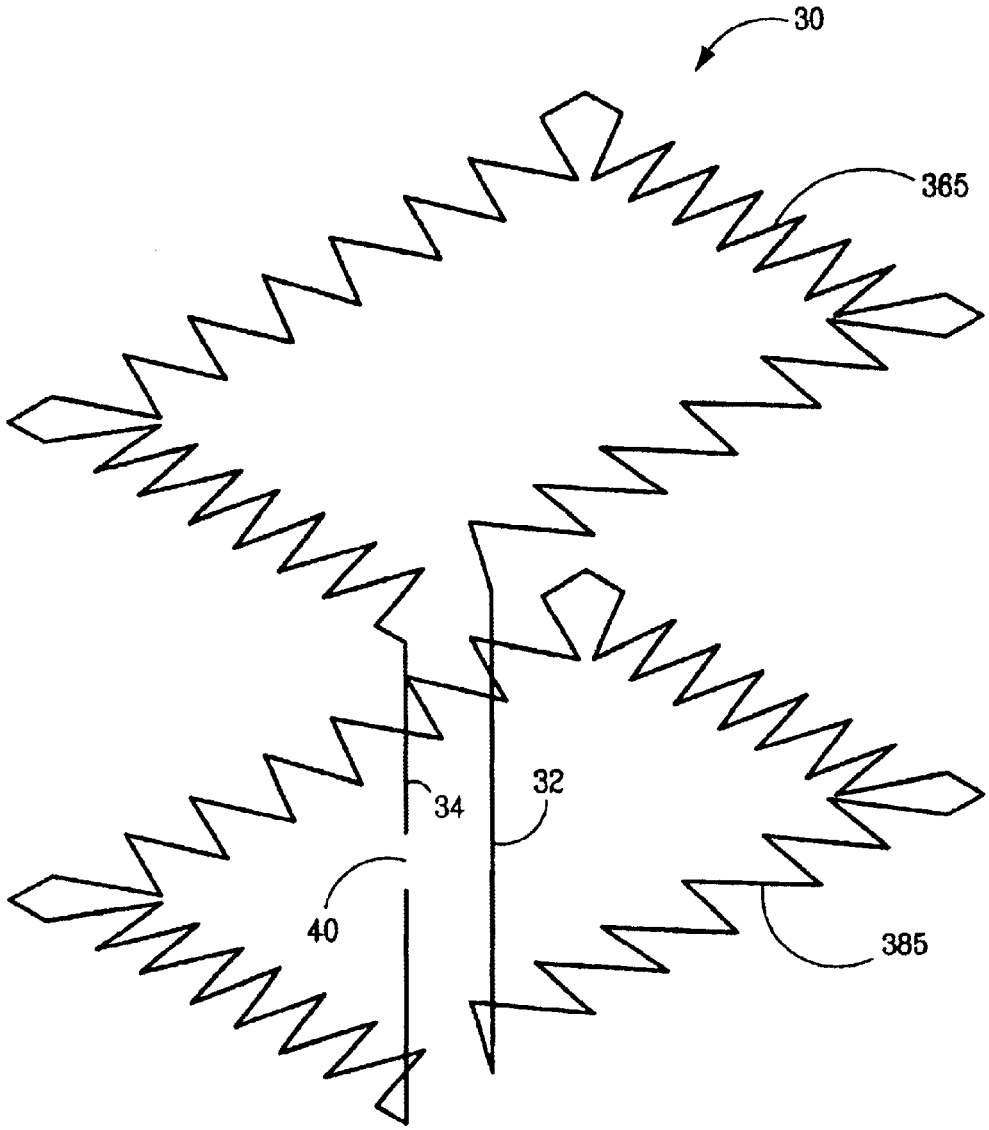
FIG. 6 illustrates electrical lengthening of the horizontal wires of a folded rectangular loop by the use of serrations.

FIG. 6 illustrates that among these were "serrated" horizontal wires. The reference numerals for like components are identical to those of FIG. 4, except that the serrated horizontal loops are designated with the suffix "S". While both horizontal wires are shown as having serrations, it will be understood that, although not deemed to be the most desirable approach, one loop may be serrated, and the other loop may be electrically lengthened by other means.

Figure 7:
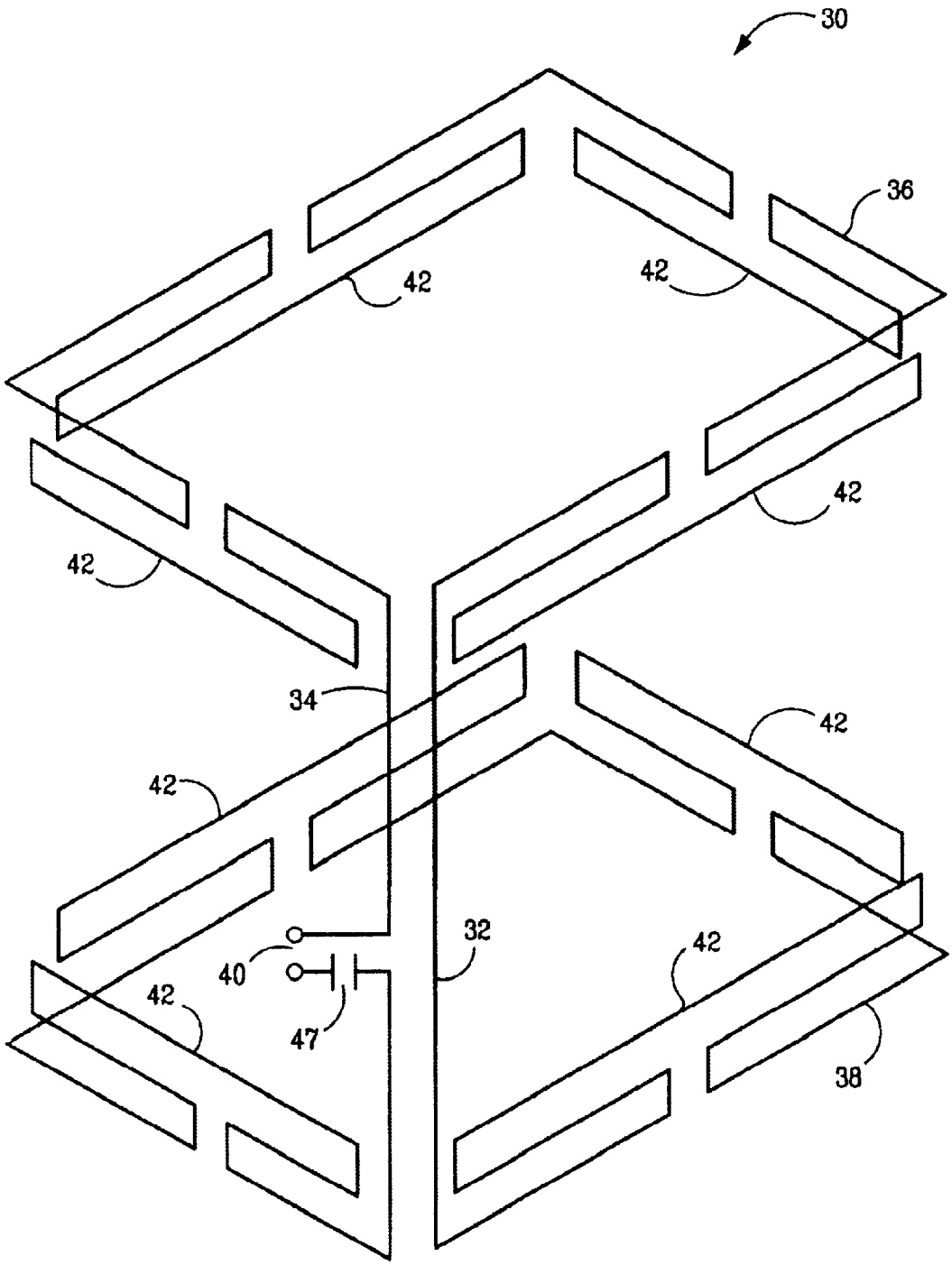
FIG. 7 illustrates a folded rectangular loop with linear loading sections.

FIG. 7, using the same numerals for like parts as FIG. 4, illustrates linear loading sections 42. Loading sections 42 comprise folded stubs. The latter proved the easiest to construct, and yielded the highest gain and thus became the basis for final designs. Also modeled successfully, but found more difficult to construct, were horizontal wires wound as spirals (as illustrated and described with respect to FIG. 16 below).

Figure 8:
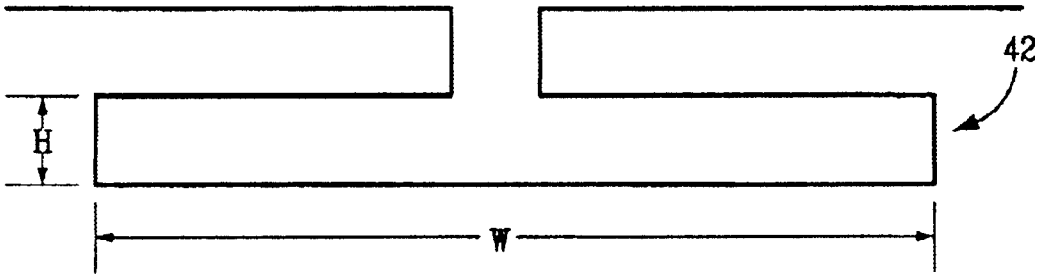
FIG. 8 illustrates a relatively enlarged view of a single linear loading section.

The design above, using the linear loading sections, produced the following parameters for Rin and gain:

Input Resistance:

FIG. 8 illustrates that an Rin of 10–100 ohms could be targeted by varying the height H or breadth W of the folded-back linear loading sections. The inductive reactance is in the range of 3000–4000 ohms and can be tuned out with a series capacitance 47 at the feed point of 5–6 pF.

At an Rin of 50 ohms, Rrad is 43 ohms, the Rloss is 7 ohms and the overall radiation efficiency is about 86%.

Resonant Tuning:

Under certain unique conditions it was determined that this antenna could be tuned directly to resonance without the need to cancel inductance.

If the antenna is made larger than nominally about 0.04 wl/side a resonant frequency with a high Rrad may be found slightly higher than the half wavelength frequency. In this case the capacitor in series with the feed may simply be used to shift the resonant frequency and/or to raise the antenna's Rrad to the appropriate value.

Gain:

This antenna has a circular-omnidirectional azimuthal radiation pattern and a gain of −1.9 dBi at an elevation of 30 degrees when modeled over a radial ground system. This is within one dB of the gain of the reference quarter-wavelength monopole. When placed over a high-density metallic grid of 0.5×0.5 λ, the gain is −1.2 dBi. Over ground, and without any metallic ground system, the gain at a TOA of 30 degrees is −4.8 dBi. The gain of this compact antenna is equal to that of the larger unloaded three dimensional antenna discussed immediately above.

Current Distribution:

The antenna currents are lowest at the fed end, progressively increase around the perimeter and become maximal at the unfed radiator 32. The current phase shows a difference of 180 degrees between the top and bottom horizontal wires (loops 36 and 38). This leads to cancellation of the horizontally polarized radiation at high elevation angles. The antenna is equivalent to a short, shorted, folded transmission line.

This current distribution, lowest in magnitude near the fed end (radiator 34) and highest near the unfed radiator 32, enables the interposition of a tuning section at the low-current corner where losses are lower, as discussed next.

Tuning:

Tuning the antenna's dimensions for an Rin of 50 ohms is necessary since the Rin varies according to ground type, the nature of a metallic ground screen or radial system, if one is in place, and the height above the ground of the bottom of the antenna.

Such tuning involves dimensional adjustments of all eight of its linear loading sections. Therefore various methods of varying the Rrad and hence the Rin were investigated. However, it is noted also that in this embodiment, the antenna can be tuned for maximal gain at a single frequency for fixed-frequency operation.

Figure 9:
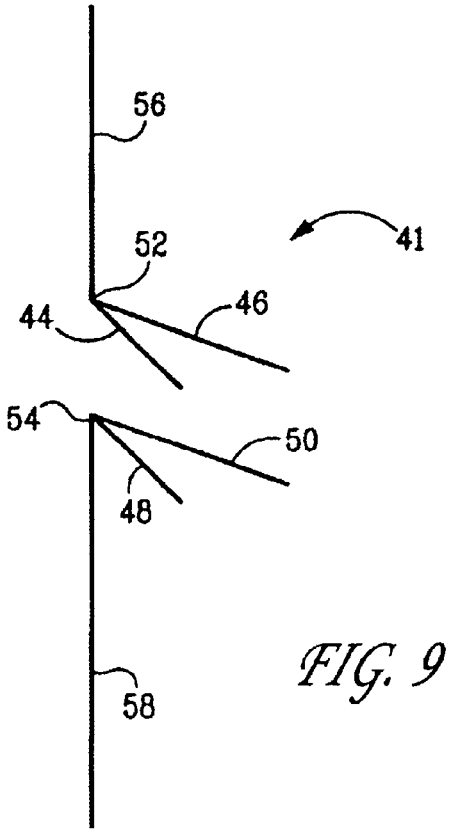
FIG. 9 illustrates a relatively enlarged view of a single corner capacitive loading section.

FIG. 9 illustrates a capacitive loading section 41, a plurality of which are included, in the next described embodiment of the antenna.

Means, other than dimensional changes, were investigated to vary the input resistance with frequency so that a 50 ohm match could be accomplished over a wide bandwidth, such as the entire extent of the 40 meter band (7–7.3 MHz). This was done over various types of ground and at various heights above ground. This bandwidth, used to illustrate the tuning capability of the final design, is 4.2% centered around 7.15 MHz. Without a means for tuning, the Rin varies from 50 ohms at 7 MHz to 240 ohms at 7.3 MHz.

A practical solution is a high-Q capacitive loading section 41, illustrated in FIG. 9, which is preferably inserted at the lowest-current corner of the antenna. The horizontal wires 44 and 46 at the top, and 48 and 50 at the bottom, form an acute angle with respective vertices 52 and 54 at respective vertical wires 56 and 58. This arrangement has a two-fold benefit: It removes these wires from proximity to the adjacent linear loading sections and allows for extension of these wires diagonally across the full internal extent of the antenna, as more fully illustrated with respect to the embodiment of FIG. 12 and FIG. 13, described below.

With respect to this capacitor loading section the term "wire" is generic. It may be comprised of wire, tubing, rod, bar stock or any other form of conductor.

Figure 10:
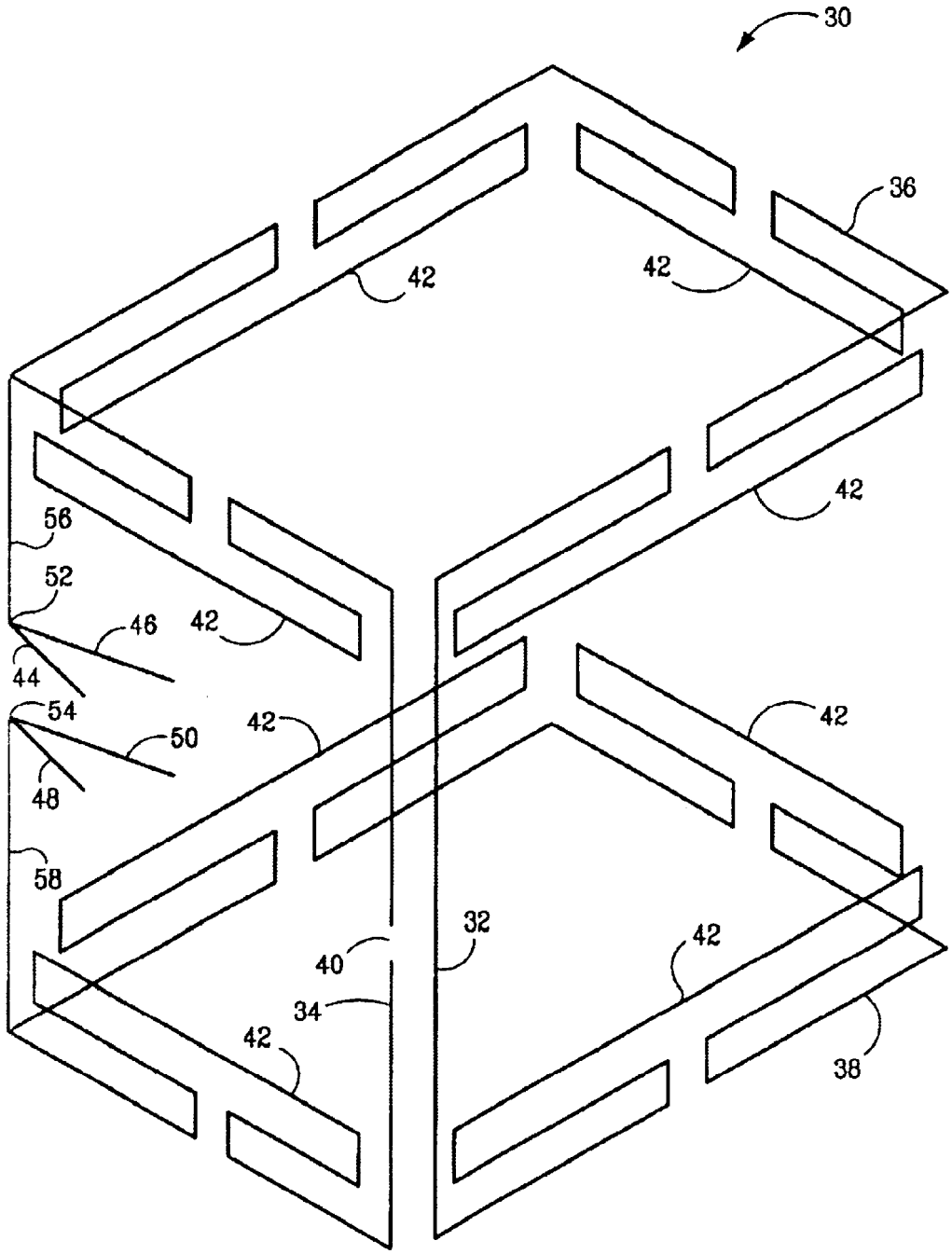
FIG. 10 illustrates a folded rectangular loop with linear loading sections and a corner capacitive loading section.

FIG. 10 illustrates an embodiment of an antenna in accordance with the invention, with the linear loading sections and capacitive corner loading section in place.

Tuning can also be accomplished by placing a variable capacitor in a similar position; at the center of a vertical wire connecting the top and bottom horizontal wires at any corner of the antenna preceding the unfed radiator. The preferred location for such a variable capacitor is the center of a vertical conductor connecting the top and bottom horizontal conductors at the corner closest to the fed radiator. Such a capacitor, if its series resistance is low, and its Q is high, enables tuning of this antenna over a bandwidth of 7:1 in frequency. Vacuum variable capacitors meet this requirement.

The characteristics of the now-tuneable compact antenna structure are as follows.

At any point where the antenna has a Rin of 50 ohms, the untuned fractional bandwidth is 7 KHz. However, by simply varying the size of each vertical leg of the capacitive loading section and the resulting width of the gap between them, the antenna can be tuned anywhere between 7.0 and 7.3 MHz. All of this can be accomplished by using a constant value capacitance in series with the feed point to tune out the inductive reactance of about 3000–4000 ohms. With this configuration, the Rrad is 43 ohms, the Rloss is 7 ohms and the radiation efficiency is 86%.

Of major importance is the fact that, while keeping the feed-gap at its smallest practical size, extending the length of the horizontal wires of the capacitive loading section up to, but not exceeding, the dimensional limits of the structure enables tuning down to a frequency of 5 MHz where the antenna's dimensions now become about 0.02 λ/side. That is the Rin remains constant at 50 ohms although the Rloss increases and the gain decreases.

Gain:

Without the presence of a ground system and over NEC "average" Sommerfeld-Norton ground, the antenna gain is −4.9 dBi. Due to the small transverse distance across the antenna, the azimuthal radiation pattern is circular. The elevation pattern shows a maximum at 29 degrees above the horizon.

At 5 MHz, the azimuthal radiation patterns remain circular and the gain at an elevation of 30 degrees decreases by slightly more than 2 dB with reference to that at 7 MHz. The latter value (−7 dBi) is still far greater than the gain of a comparable Compact Loop. With a ground system in place, the gain is about −4.5 dBi.

EXAMPLE

Prototype:

A prototype of this antenna, scaled for 14 MHz (65 cm/side), can be constructed in order to confirm the antenna modeling predictions. It tunes to resonance, at an Rin of 50 ohms, over 10–14.35 MHz by varying the dimensions of the corner capacitive loading section. For a production model, the tuning can be motorized and servo-controlled.

If a variable capacitor is used (5–400 pF) to tune the antenna, the tuning range is 14–7 Mhz.

Further Reduction in Size with the Addition of Linear Loading Sections to the Radiators:

The 7 MHz antenna discussed above is investigated when the overall dimensions are reduced to 1 m/side. An Rin of 50 ohms can not be attained at 7 MHz without the use of a variable capacitor.

Figure 11:
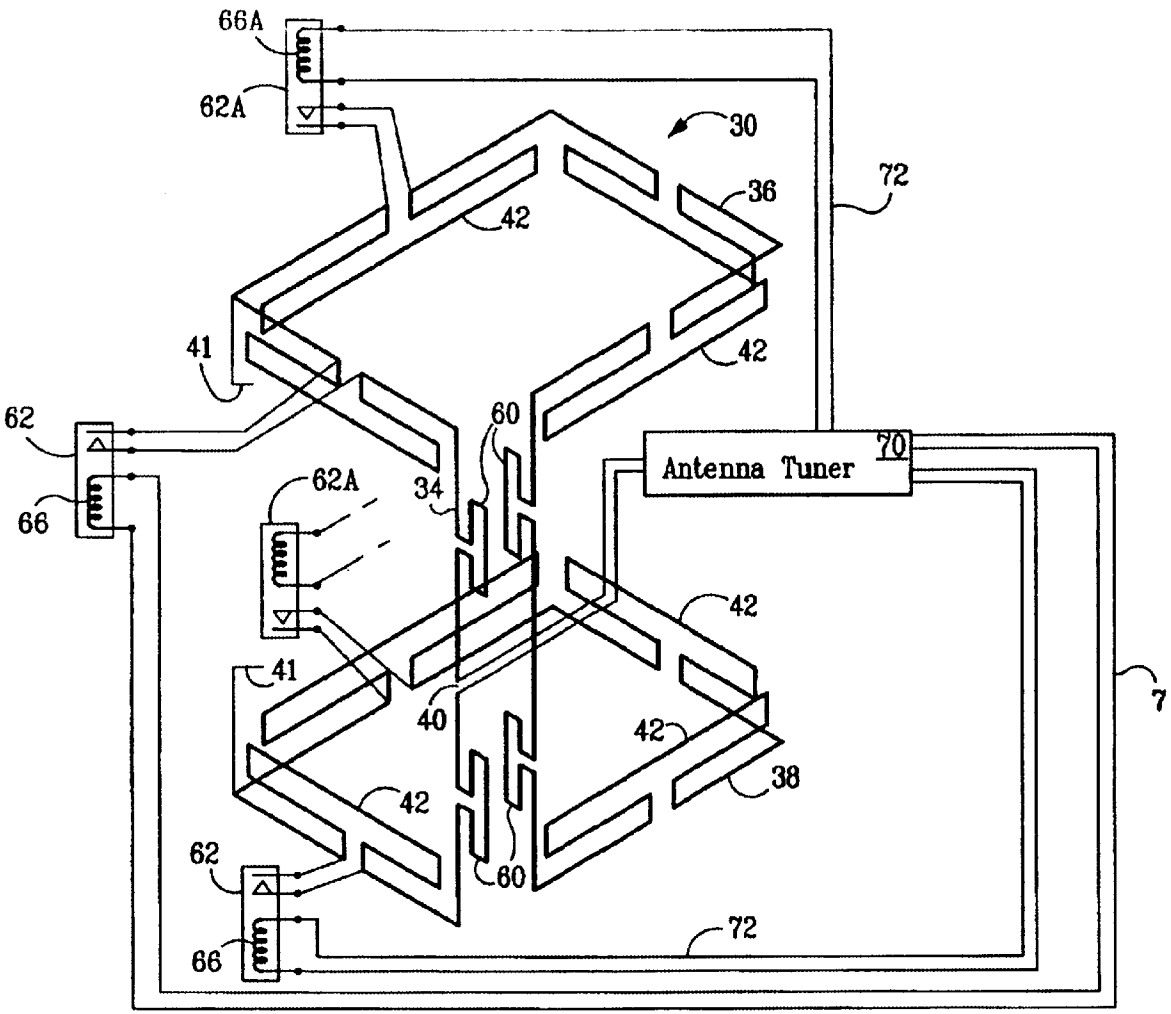
FIG. 11 illustrates a folded rectangular loop with linear loading sections in both the vertical radiators and the horizontal wires, including matching circuitry.

FIG. 11 illustrates a solution. Two linear loading sections 60 are added outboard from the center of each vertical radiator. These sections are located at those specific positions with that specific relationship between them in order to minimize coupling between the two radiators.

At an Rin of 50 ohms, Rrad is 33.5 ohms and Rloss is 16.5 ohms. This corresponds to a radiation efficiency of about 67%. The cost of this reduction in size is 2 dB.

The untuned bandwidth at 7 MHz is 8.2 KHz. The antenna can be tuned, with a corner capacitive loading section 41, from 7.4 MHz to slightly below 7 MHz. With a variable capacitor of 10 to 1000 pF, tuning is achieved down to a frequency of 3 MHz.

The antenna can be investigated as to how it can be best matched beyond the upper limit of the range where the internal matching system would insure a perfect resistive match at 50 ohms, and below 5 MHz where the Rin falls below 50 ohms.

Over a wider range of frequencies, the limiting factors are:

A variable capacitor placed at the center of a radiator in the corner adjacent to the fed radiator enables tuning down to a frequency of 3 MHz or lower. At this frequency, the gain is still substantially greater than that of a comparably sized Compact Loop due to the higher Rrad and lower Rloss.

Above the design frequency: the limiting factors are the frequencies at which the electrical loop perimeter is an odd 0.5 λ multiple of the primary resonant frequency, which is 15.5 MHz. The antenna becomes an open-circuit at these points and demonstrates wide impedance excursions. The first such point occurs at approximately 7.8 MHz and the second at about 22 MHz.

Enabling Tuning at the Frequencies where the Antenna is an Electrical Open Circuit:

This problem can be dealt with by using relays 62 to simply short any single pair of the linear loading sections 42; specifically one in the top loop 36 and one in the bottom loop 38. This electrically shortens the antenna and shifts the first "open-circuit" frequency upward by 800 KHz. A match is obtainable easily within 500 KHz on either side of the impedance peak. The best position for such a short is across the gap of the linear loading sections at the top and bottom immediately after the fed radiator, because the antenna currents are the lowest there. However, additional pairs of relays 62A (only a portion of the lower relay 62A being shown) may be used to short out additional pairs of linear loading sections 42.

With these single pole, single throw shorting relays 62 (and possibly 62A) in place, the antenna can be matched with an external antenna tuning system 70 up to and beyond 35 MHz. The antenna tuning system may have an appropriate source of energy for activating coils 66 (and 66A) of relays 62 (and 62A) either manually or automatically by passing a current along control lines pairs 72. The antenna tuning system 70 may be any one of those well known in the art, such as those having capacitive and inductive components in L, T or Π configurations.

Therefore, this antenna, nominally designed for 7 MHz can be used from 3 to 35 MHz. It can be intrinsically tuned, without an external device, for an Rin of 50 ohms from 5 to 7.3 MHz when using a corner capacitive loading section, from 3 MHz to 7.3 MHz, if a variable capacitor is used, and beyond those limits with an external device.

Although the discussion above refers to a compact antenna designed for 7 MHz, the dimensions can be scaled for any other frequency from MF to UHF. For higher gain and efficiency, overall dimensions of 0.025 λ/side are best. However, dimensions of 0.02 λ at any operating frequency still yield gains that far exceed those of Compact Loops. At higher HF and into VHF/UHF, where dimensional limitations are less restrictive, larger antennas yield higher gains. As an example, a dimension of 0.03 λ/side enables one to attain a gain equal to that of a full-sized monopole and a dimension of 0.04 λ/side enables a gain equal to that of a full-sized dipole.

Figure 12:
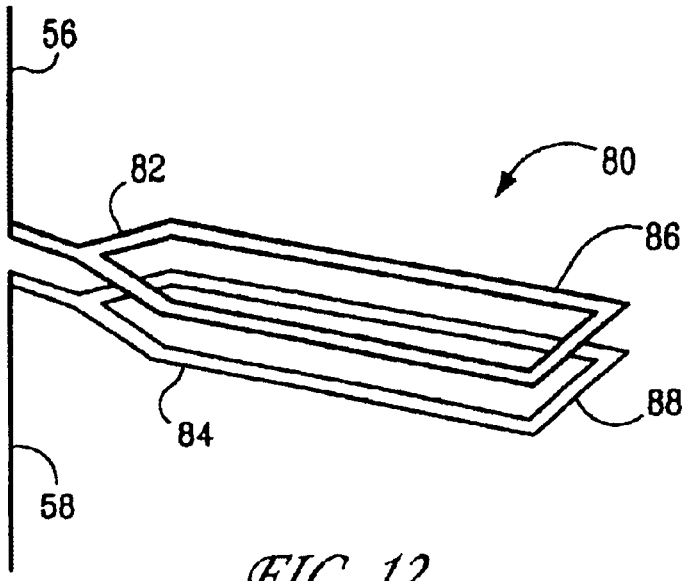
FIG. 12 illustrates another embodiment of a corner capacitive loading section in accordance with the invention in an extended configuration.
Figure 13:
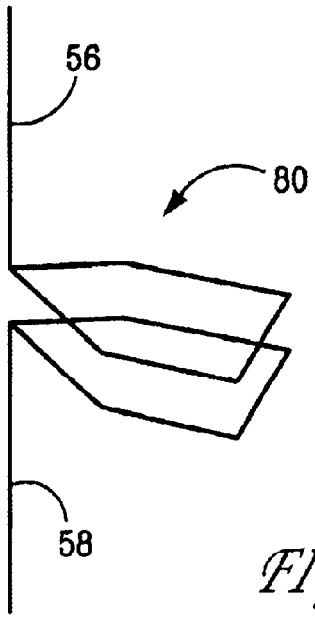
FIG. 13 illustrates the embodiment of the capacitive loading section of FIG. 12 in a retracted configuration.

FIG. 12 and FIG. 13 illustrate another embodiment of a capacitive loading section 80, which may be used as illustrated in FIG. 10. Capacitive loading section 80 has an upper section 82 connected to vertical conductor 56 and a lower section 84 connected to vertical conductor 58. As noted above, the conductors may be any form of metallic stock be it tubing, rod or bar stock. Sections 82 and 84 may be formed of tubular metal "Y" shaped portions with the end of the "Y" being connected to the conductors 56 and 58, and the arms of the "Y" each receiving an end of a respective tubular member 86 or 88. Thus, tubular members 86 and 88 may have an outer diameter that results in tubular members 86 and 88 being closely received within the arms of sections 82 and 84, so as to be able to slide therein. This enables capacitive loading section 80 to have a continuously adjustable capacitance, that is lowest when retracted to the position illustrated in FIG. 13, and highest when extended as illustrated in FIG. 12. Suitable clamps (not shown) may be provided to secure tubular members 86 and 88 within the arms of sections 82 and 84, at a selected position to provide an appropriate desired capacitance. It will be recognized that arrangements other than the telescoping tubes illustrated herein may be used, such as simply clamping solid tubes to one another at different extended or retracted positions.

Figure 14:
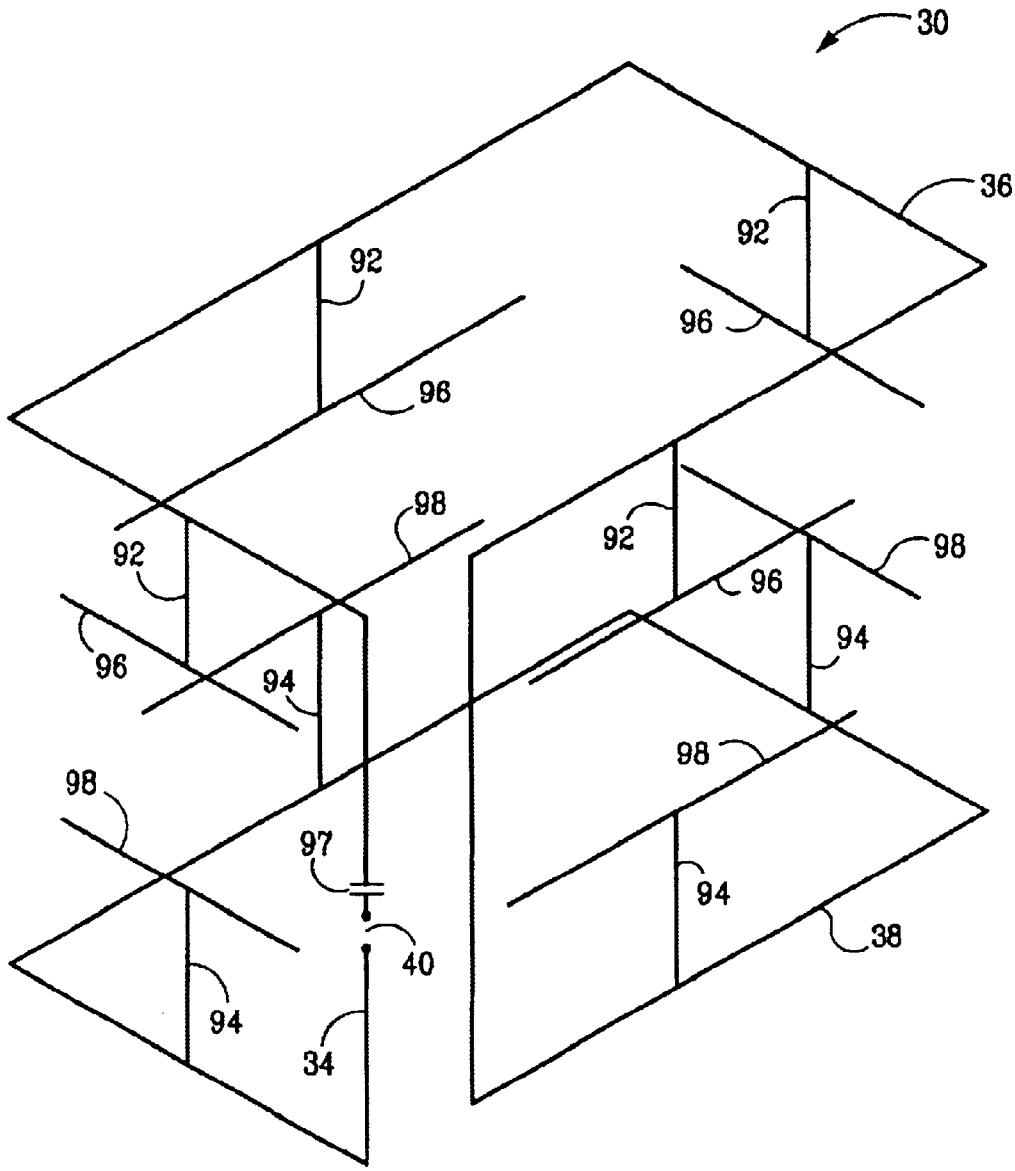
FIG. 14 illustrates a folded rectangular loop with a mid-horizontal capacitive loading section in accordance with another embodiment of the invention.
Figure 15:
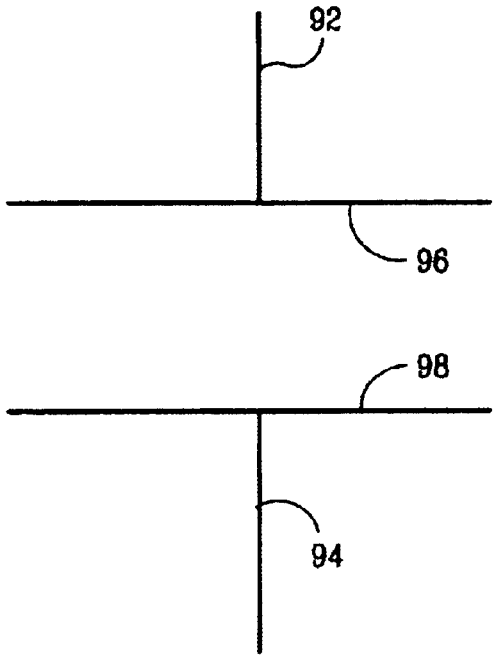
FIG. 15 illustrates the mid-horizontal capacitive loading section used in the embodiment of FIG. 14.

FIG. 14 illustrates an embodiment of the invention wherein an antenna 30 includes a plurality of capactive loading sections 90, preferably located at mid horizontal positions along the horizontal loops 36 and 38. Referring also to FIG. 15, sections 90 are each formed of a first wire 92 extending from loop 36 and a second wire 94 extending from loop 38. The ends of wires 92 and 94 not attached to their respective loops, are connected to horizontal wires 96 and 98, respectively, which are parallel to one another. Such "T" type sections, located at the midpoints of each of plurality of four pairs of top and bottom horizontal wires, work almost as effectively as the linear loading sections 42 of FIGS. 7, 8, 10 and 11, and do not change any of the operating parameters of the antenna when compared to the linear loading sections 42. Capacitance may be adjusted by varying the length of wires 96 and 98, and the spacing between them, such as by changing the length of wires 92 and 94. A series feed capacitor 97 is provided.

It is noted that the vertical members of these capacitive loading sections provide some degree of electrical lengthening in and of themselves, and add to the gain of the antenna.

In general, the mechanical arrangements for providing capacitance as described above may be replaced by a variable capacitor of high Q value, when it is inserted at the center of a vertical radiator which is located at the corner nearest the fed radiator. This location was empirically determined as allowing the highest gain for the antenna, although this radiator may be placed at any point along the perimeter between the top and bottom horizontal conductors. For example a vacuum variable capacitor having a series resistance of 0.01 ohms or less may provide excellent performance, and a tuning range of greater than 4:1 (2 octaves) in frequency. These capacitors may be motor driven to facilitate tuning.

Figure 16:
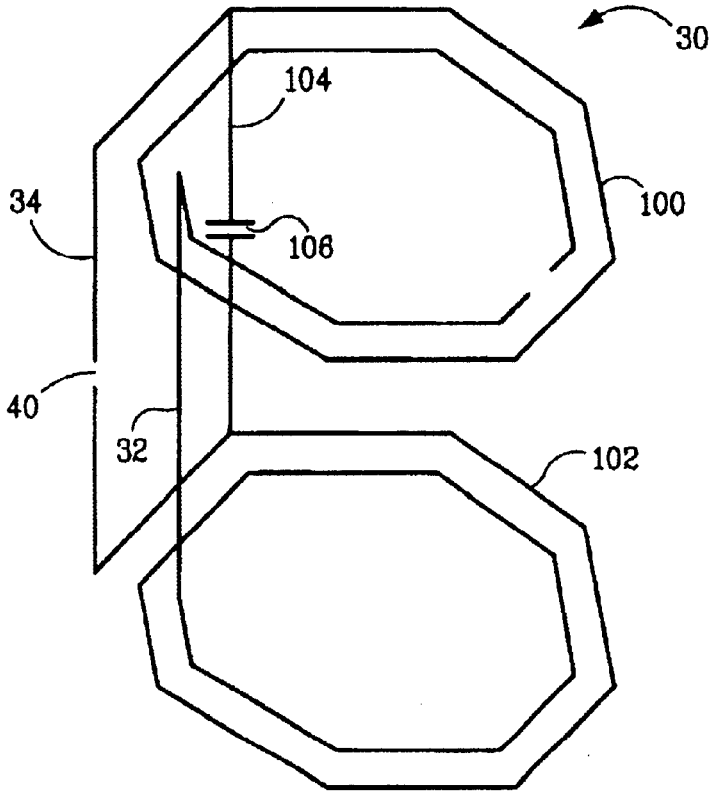
FIG. 16 illustrates a spiral wound embodiment of an antenna in accordance with the invention.

FIG. 16 illustrates an embodiment of the invention wherein a fed radiator 34 and a radiator 32, which is not fed, are connected by two spirally wound loops 100 and 102. The horizontal loops 100 and 102 are made as long as is necessary by spiraling them outward from a radiator at the center. The size falls within the dimensions of a cube having a side of 1.3 meters. An additional radiator 104 connects loops 100 and 102. Radiator 104 has disposed along its length a tuning capacitor 106. Radiator 104 is close to the fed radiator, and is thus at an ideal position to carry a variable capacitor, which is in parallel with the source or feed point. The optimal position for radiator 104 along the spiral loops 100 and 102 may be determined by modeling and experimentation. Ordinarily this would be the "corner capacitor" on the 4-sided folded rectangle of, for example, FIG. 10, but a spiral has no corner. This capacitor 106 allows for tuning over a very wide range of frequencies (7.5 to 4.5 MHz) and is much simpler to implement than a "V" or "paddle" of FIG. 9 and FIG. 12, respectively.

Although the three-dimensional antennas discussed above are vertically polarized, they may be rotated 90 degrees and used in a horizontally polarized manner. Computer modeling indicates that if the described above are rotated such that the radiators are horizontal, radiation patterns will be similar to those of a horizontal dipole at the same height above ground. A 0.025 λ/side antenna will have a gain deficit of less than 2 dB as compared to a full-sized 0.5 λ dipole. Again, this far exceeds the gain of a Compact Loop similarly situated.

Compact Planar Antennas

In addition to providing the compact three dimensional antennas discussed above, the stated goal of the present invention, is the creation of a compact-loop based planar antenna with a maximum greatest dimension of a fraction of a wavelength, with an electrical size that may be increased to the point that the Rin is 50 ohms at any desired frequency. The point at which this occurs is when the loop is slightly smaller electrically than 0.5 λ at the desired frequency. This in turn results in much higher gain due to swamping of the fixed resistive losses. In doing so, the following was discovered with respect to a three-dimensional loop:

A. The inclusion of an extra radiator, opened at is center, in parallel with the two other radiators which formed a desired rectangular antenna, increased the gain of the antenna and increased its electrical length.

B. The extra radiator, when opened at its center, also serves to provide a means for tuning such an antenna over wide frequency bandwidths. This is accomplished by inserting a variable capacitor at the center of this radiator. The capacitor, which is in a radiator in parallel with the fed radiator, will be referred to as the parallel capacitor (Cparallel). This is to distinguish it from a capacitor which must be inserted in series with the antenna's feedpoint and which serves to tune out inductive reactance (Cseries).

The capacitor could then enable one to target an input resistance (Rin) of 50 ohms over a large range of frequencies—which may exceed 7:1 depending on the range of the capacitor.

Figure 17:
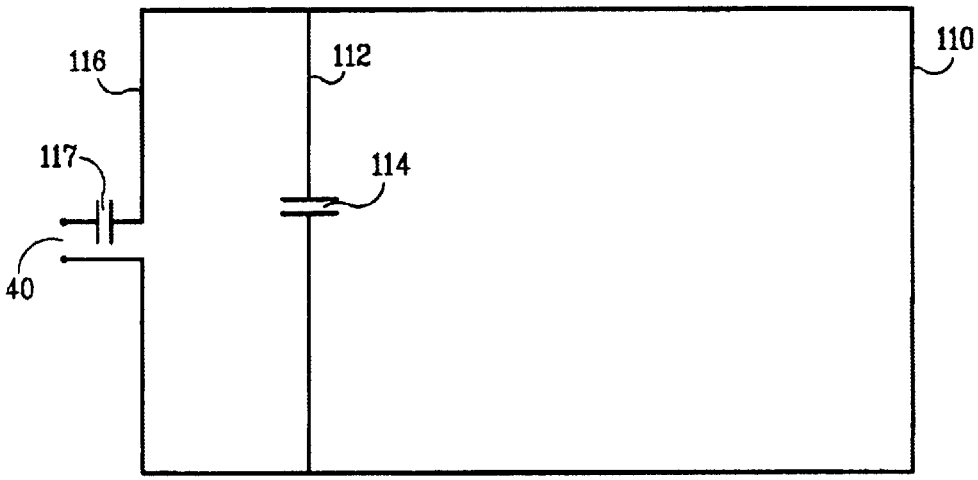
FIG. 17 illustrates an additional embodiment of the invention that utilizes as additional loop and tuning element.

FIG. 17 illustrates an embodiment of the invention wherein a simple compact loop 110 comprises one of the extra parallel radiators 112 containing a variable capacitor 114, so as to totally change its electrical characteristics, and to add gain due to the presence of this additional radiating element. First a simple square is converted to an asymmetrical double rectangle or "ADR". This name comes from conjoining two unequal-sized rectangular loops onto each other. This is accomplished by taking a symmetrical square loop and adding an extra tuning radiator inboard from the feed radiator. The outboard radiator 116 is fed and contains a series reactance tuning capacitor 117. The parallel tuning capacitor 114 enables tuning over a very large range, which may span 3–21 MHz.

The parallel capacitor 114 moves the frequency where the antenna is a half electrical wavelength in size. The greater the capacitance, the lower the frequency. It is a simple task to add sufficient capacitance to reach the Rin=50 ohm point anywhere in the tuning range of the antenna.

Thus, what the added radiator 112, with the parallel capacitor 114 does, as mentioned above, is to shift the operating curve of the antenna by placing the Rin=50 ohm, XL=inductive point, which occurs at a frequency just below the half-wave point, exactly where desired. This effectively increases the Rrad of the antenna and swamps or buries the small, fixed losses of the other elements such as the variable capacitors, rendering them insignificant. To differentiate this from a simple matching device, the added radiator changes the intrinsic character of the antenna by effectively increasing the ratio of Rrad to Rloss and thereby significantly increasing gain. Importantly, and serving as another point of differentiation from a matching device, this wire radiates and increases the gain of the antenna in and of itself.

Figure 18:
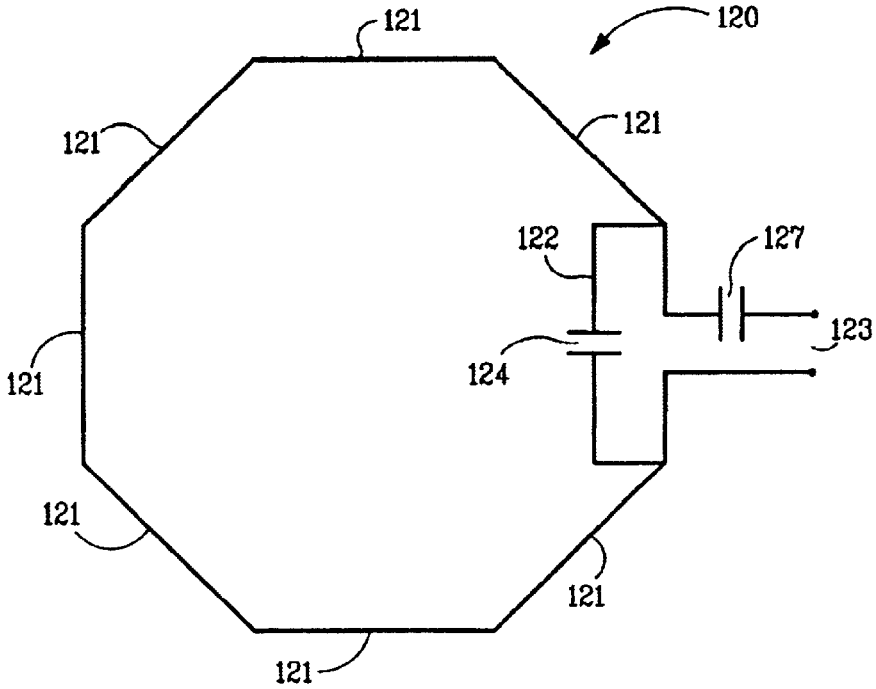
FIG. 18 illustrates an embodiment of the invention similar to that of FIG. 17, having an octagonal loop.

Referring to FIG. 18, the best antenna 120 of this type is the octagonal version, which has a gain approximately one db higher than that of the antenna of FIG. 17. Because of the shorter sides 121, the extra radiator 122 can be attached at low current points on either side of the feed point 123, which feeds a series tuning capacitor 127. This decreases the losses and increases the gain. As in FIG. 17, a parallel tuning capacitor 124 is used.

EXAMPLES AND CONSTRUCTION

Example 1

In one embodiment, the external loop is a square having a perimeter of 4.08 m. Inside it, is placed another radiator which is 0.2 m from the fed loop.

This radiator contains a Cparallel of 146 pF. This places the R=50 ohm point at 7 MHz. The reactance (X) is 1,952 ohms and this can be tuned out by a Cseries of 11.34 pF.

The gain, at a TOA of 30 degrees is −7.5 dBi. Depending on how well the simple reference compact loop in FIG. 1 is constructed and matched, this embodiment of the square loop, with an extra radiator has a greater gain of 2.5 to 6.5 dB.

Further studies and confirmation of modeling predictions with measurements on prototype antennas led to the following preferred embodiment:

Example 2

This is an octangonal loop with an added radiator of the type illustrated in FIG. 18.

By choosing the appropriate value for the variable capacitance, the antenna is made to tune (that is to have an input resistance (Rin) of 50 ohms) over a frequency range exceeding 7:1. The parallel capacitor 124 moves the frequency where the antenna is a half electrical wavelength in size. The greater the capacitance, the lower the frequency. It is a simple task to add sufficient capacitance to reach the Rin=50 ohm point anywhere in the tuning range of the antenna. Since the antenna's reactance (X) is always positive a Cseries at the feedpoint has to be provided in order to tune out the reactance.

The Rrad of such an antenna is many orders of magnitude greater than the Rrad of a simple Compact Loop lacking the added design embodiment.

In this embodiment, the antenna in question, a 4.08 m perimeter octagonal compact loop, is identical to the simple reference compact loop discussed above except for the addition of an extra radiator which emanates from the first obtuse angles at either side of the vertical feed radiator.

Wires orthogonal to each end of the radiator accommodating the feed point and of 10 cm length are connected orthogonally to the tuned radiator at both of its ends. Each radiator is 51 cm long (one eight the perimeter of 4.08 m).

This antenna has the following characteristics at 7 MHz:

With the parallel tuning capacitor (Cparallel), at the center of the additional radiator, of 136 pF (pico Farads), the antenna has a Rin of 50 ohms. The inductive reactance of 2,751 ohms can be tuned out with a capacitance in series with the feedpoint (Cseries) of 8.26 pF.

The lossless resistance or Rrad is 30 ohms, corresponding to an efficiency of 60% (Rrad/Rin). The gain, 1 m above S-N average ground is −4.77 dBi. This is almost identical to that of a lossless simple Compact Loop without the addition of a lossy matching network and Cseries to tune out its reactance.

However, the introduction of even 1 ohm of series loss, anywhere in the antenna circuit, results in a loss of gain of less than 0.1 dB to −4.85 dBi. A simple compact loop with an added Rloss of 1 ohm has a gain of −14.1 dBi. The difference in gain approaches one order of magnitude or almost 10 dB. If used over a metallic ground system of 64 radials, the gain at 7 MHz is −1.5 dBi and is within 0.5 dB of that of a quarter-wave monopole over the same ground system.

Since this compact loop with the additional tuning radiator is electrically much longer than the simple compact loop (having Rin=50 ohms rather than Rin=0.12 ohms, of which only 0.07 ohms is the Rrad) the small Rloss is swamped by the high Rin and is rendered negligible and of no practical consequence. The novel tuning radiator embodied in this antenna enables a loop of only 0.095 λ in perimeter (or 0.03 λ in diameter) to act as if it were close to 0.5 λ electrically.

This antenna can be tuned, by varying the Rparallel from to 780 pF, over a frequency range of 21 to 3 MHz or 7:1. That is, by varying the Rparallel, it may be tuned to a Rin of 50 ohms anywhere in this range. This tuning range is well within the capability of a vacuum variable capacitor which has a Rloss of only 0.01 ohm. The gain at 21 MHz is +0.6 dBi and, at 3 MHz it is −13.9 dBi.

Note that at 3 MHz the antenna is only 0.03 λ in perimeter. A comparable simple compact loop has a Rrad of 0.01 ohms (10 milliOhms) and, with only 0.5 ohms of loss resistance (and without a matching network) its gain is −25 dBi. With a matching network (5,000:1), the gain may be conservatively estimated at −28 dBi or worse.

The antenna in this embodiment is too "large" to tune to 30 MHz. However, a 0.9 m diameter (2.82 m perimeter) loop can be tuned from 30 to 7 MHz by varying the capacitance from 5–210 pF. Due to its smaller size, the gain at 7 MHz falls to −7 dBi. This is still an order of magnitude higher than that of a comparably sized simple compact loop.

To reiterate, the addition of the tuning radiator enables a loop of only 0.03 λ in perimeter to perform as if it were close to 0.5 λ in perimeter.

It is noted that the above gain figures are produced with a relatively thin wire, rod or tube structure of 19 mm elements. If one were to increase the diameter of the wire or tubing to a more commonly used value at lower HF frequencies of 2" (50 mm) the gain at 3 MHz would increase by about 4 dB to −10 dBi. Due to skin effect, tubes are generally as effective as solid rods.

The radiation characteristics of these compact planar loops are different from those of the cubes which have omnidirectional azimuthal patterns and low-angle elevation patterns. They radiate exactly in the same manner as the simple prior art compact loops, as described above. In summary, they have azimuthal directivity since their maximum gain is end-fire off the ends or parallel to the plane of the loop, and have at least a 3 dB loss of gain in the broadside direction (broadside to the plane of the loop). In the elevational plane, the maximum radiation is at the zenith and is about 1 dB greater than the gain quoted above, which is determined at a takeoff angle of 30 degrees above the horizon. Still, there is sufficient radiation, at the standard TOA of 30 degrees used for comparison, to equal that of a three dimensional compact rectangle cube, provided the simple loop is oriented favorably. The susceptibility to high arrival-angle radiation may be detrimental in some cases. However, the elevation directivity can be useful in some circumstances such as NVIS (near-vertical incidence skywave) propagation where high arrival angles must be covered.

In summary, the radiation characteristics show that there is ample gain low to the horizon for long-distance communication and higher above the horizon for NVIS (or near-vertical incidence sky wave) propagation.

As noted above, although the compact antennas discussed herein are vertically polarized and operated close to ground, they function well when they are rotated (90 degrees) so that their plane is parallel to the earth, they are horizontally polarized, and they are placed at greater heights.

More specifically, when elevated at least ¼ wavelength above ground they become excellent, high gain, low radiation takeoff angle antennas. Their azimuthal pattern is omnidirectional and their elevation lobes are identical with those of full-sized half-wavelength dipoles at the same height above ground. As an example, the octagonal embodiment discussed above, when tuned for 14 MHz and when situated at a height of 0.5 λ above ground, has a omnidirectional gain of 4.51 dBi at a TOA of 26 degrees. When it is at a height of 1 λ, the gain is 5.76 dBi at 15 degrees. Similar results can be obtained if one uses 3" (75 mm) conductors at 7 MHz. More importantly, they radiate at lower TOAs than a full-wave horizontal loop at the same height above ground.

It is noted that the principle of using a radiator which contains a capacitor at its center may be applied to a loop of any shape (from a triangle to polygon of "n" sides to a circle) . The scope of this invention therefore includes loops of any shape.

With any loop (as defined above) what is important is the length of the tuning radiator, the distance on either side of the feed point from which the orthogonal wires originate, and the distance this radiator is offset from the fed wire. These may be determined from modeling and/or empirical testing to find the configuration which results in the greatest gain. These dimensions therefore are all within the scope of this invention.

The extra radiator need not be straight and may be bent into many shapes. All are more or less effective but, for each type of loop, wire diameter or loop perimeter there is a best configuration which may be arrived at by modeling and testing. Therefore, the scope of this invention includes any such wire of any shape.

The value of the capacitance of the tuning capacitor at the center of this radiator is also determined from modeling and/or empirically as that value needed to tune the antenna to whatever frequency is desired based on a given loop perimeter. Although the position of this tuning capacitor may be non-central on the tuning radiator, it is most effective when centered. Therefore it is within the scope and spirit of this invention that this capacitor may be placed at any position on the tuning radiator. A very significant advantage of these compact loop antennas in accordance with the invention is that the frequency bandwidth through which the antenna may be tuned is limited solely by the range of capacitance range of this capacitor. More specifically, each loop perimeter has a upper limit on its tuning range. This is determined by the loop perimeter and the lowest value of tuning capacitance available. The smaller the loop and the lower the capacitance, the higher the upper frequency limit. The lower frequency limit is the converse of the above. This is determined by the loop perimeter necessary to achieve the desired minimum gain and the maximum value of the available tuning capacitance. If gain is not a design limit and large value capacitors are available, even very small loops can be tuned at very low frequencies.

The above invention was described with specific embodiments, but a person skilled in the art could introduce many variations on these embodiments without departing from the spirit of the disclosure or the scope of the appended claims. For example, the radiating elements and loops discussed herein may be comprised of fractal antenna elements, such as those disclosed and referenced in U.S. Pat. No. 6,476,766. Thus, the embodiments are presented for the purpose of illustration only and should not be read as limiting the invention or its applications. Therefore the embodiments should be interpreted with the spirit and scope of the invention.

Further, various alternatives and modifications can be devised by those skilled in the art without departing from the invention. Accordingly, the present invention is intended to embrace all such alternatives, modifications and variances that fall within the scope of the appended claims.

What is claimed is:

1. An antenna comprising:

a first radiating element having a first end and a second end;

a second radiating element disposed parallel to and in close proximity to said first radiating element, said second radiating element having a first end and a second end;

a first conductive loop connecting said first end of said first radiating element and said first end of said second radiating element;

a second conductive loop connecting said second end of said first radiating element and said second end of said second radiating element; and a discontinuity in said first radiating element, said discontinuity being a feed point for supplying radio frequency energy to said first radiating element.

2. The antenna of claim 1, wherein said first loop and said second loop are parallel to one another.

3. The antenna of claim 1, wherein said first loop and said second loop comprise a polygon.

4. The antenna of claim 1, wherein said first loop and said second loop comprise a rectangle.

5. The antenna of claim 1, wherein said first loop and said second loop comprise a circle.

6. The antenna of claim 1, wherein said first radiator, said second radiator, said first loop and said second loop, form a polyhedron.

7. The antenna of claim 1, wherein said first radiator, said second radiator, said first loop and said second loop, form a hexahedron.

8. The antenna of claim 1, further comprising serrations along at least one of said first loop and said second loop for increasing the electrical length of the antenna.

9. The antenna of claim 1, further comprising loading sections along at least one of said first loop and said second loop for increasing the electrical length of the antenna.

10. The antenna of claim 9, wherein said loops have a discontinuous region for connection to said loading sections, and said loading sections are linear loading sections.

11. The antenna of claim 10, wherein said linear loading sections comprise a loop having a discontinuous portion, and said linear loading sections are connected to one of said first loop and said second loop at said discontinuous regions.

12. The antenna of claim 11, wherein said linear loading sections are connected to one of said first loop and said second loop at said discontinuous portions.

13. The antenna of claim 9, further comprising a first shorting relay for shorting a first linear loading section in said first loop and a second shorting relay for shorting a second linear loading section in said second loop.

14. The antenna of claim 9, further comprising a third shorting relay for shorting a third linear loading section in said first loop and a fourth shorting relay for shorting a respective fourth linear loading section in said second loop.

15. The antenna of claim 1, further comprising at least one capacitive loading element connected between said first loop and said second loop.

16. The antenna of claim 15, wherein said at least one capacitive loading element is connected between low current points of said first loop and said second loop.

17. The antenna of claim 15, wherein said at least one capacitive loading element is connected between lowest current points of said first loop and said second loop.

18. The antenna of claim 15, wherein said at least one capacitive loading element comprises:

a first conductor having a first end and a second end, said first end of said first conductor being connected to said first loop;

a second conductor having a first end and a second end, said first end of said first conductor being connected to said second loop;

a conductive element connected to said second end of said first conductor;

a conductive element connected to said second end of said first conductor; and said first conductive element and said second conductive element being separated by a non-conductive gap.

19. The antenna of claim 18, wherein said first conductive element and said second conductive element are congruent, and are disposed so as to be parallel to one another.

20. The antenna of claim 19, wherein said first conductive element and said second conductive element are disposed so as to be parallel to said first loop and said second loop.

21. The antenna of claim 18, wherein at least one of said first conductive element and said second conductive element comprise conductors at an acute angle to one another, said first conductive element and said second conductive element being disposed so as to be parallel to one another.

22. The antenna of claim 21, wherein said first conductive element and said second conductive element are disposed so as to be parallel to said first loop and said second loop.

23. The antenna of claim 18, wherein said first conductive element and said second conductive element each comprise a first conductive tubular member, and a second conductive tubular member, said second tubular member being slidingly engaged so that capacitance of said first and second conductive elements may be adjusted.

24. The antenna of claim 18, further comprising a capacitor in series with said feed point, said capacitor being selected to have a value to tune the inductance of the antenna to a frequency of interest.

25. The antenna of claim 18, wherein said capacitor has a substantially fixed capacitance.

26. The antenna of claim 1, wherein said first loop and said second loop comprise polygons, further comprising capacitive loading elements connecting centers of sides of said polygons.

27. The antenna of claim 1, further comprising:

a first loading section in said first loop;

a second loading section in said second loop;

a first shorting relay for shorting said first loading section; and a second shorting relay for shorting said second loading section.

28. The antenna of claim 27, further comprising:

a third loading section in said first loop;

a fourth loading section in said second loop;

a third shorting relay for shorting said third loading section; and a fourth shorting relay for shorting said fourth loading section.

29. The antenna of claim 27, in combination with an antenna tuner, said antenna tuner providing a source of energy for selectively activating said relays.

30. The antenna of claim 1, configured so that said first loop and said second loop traverse a length of between 0.08 and 0.16 of the wavelength of the energy to be radiated.

31. The antenna of claim 1, configured so that said first loop and said second loop are shaped as congruent squares having a dimension of between 0.02 and 0.04 of the wavelength of the energy to be radiated, for each side of said squares.

32. The antenna of claim 1, further comprising a capacitor in series with said feed point, said capacitor being selected to have a value to tune out the inductance of the antenna at a frequency of interest.

33. The antenna of claim 1, wherein said first loop and said second loop comprise helical portions.

34. The antenna of claim 1, in combination with an antenna tuner for resonating said antenna throughout a range of frequencies.

35. The antenna of claim 1, wherein said first loop and said second loop are spirally wound.

36. The antenna of claim 35, further comprising a third radiating element connecting said first loop and said second loop.

37. The antenna of claim 36, wherein said third radiating element has a tuning capacitor disposed along its length.

38. An antenna comprising:

a first radiating element having a first end and a second end;

a second radiating element disposed parallel to and in close proximity to said first radiating element, said second radiating element having a first end and a second end;

a first conductive loop connecting said first end of said first radiating element and said first end of said second radiating element;

a second conductive loop connecting said second end of said first radiating element and said second end of said second radiating element;

a discontinuity in said first radiating element, said discontinuity being a feed point for supplying radio frequency energy to said first radiating element;

at least one reactive loading section in said first loop and at least one reactive loading section in said second loop; and a variable capacitor connected between said first loop and said second loop for tuning said antenna.

39. A method for tuning an antenna having a first radiating element having a first end and a second end; a second radiating element disposed parallel to and in close proximity to said first radiating element, said second radiating element having a first end and a second end; a first conductive loop connecting said first end of said first radiating element and said first end of said second radiating element; a second conductive loop connecting said second end of said first radiating element and said second end of said second radiating element; and a discontinuity in said first radiating element, said discontinuity being a feed point at which radio frequency energy is be supplied to said first radiating element, said method comprising:

placing a capacitance between said first loop and said second loop.

40. The method of claim 39, wherein said capacitance is placed between points of low current in said loops.

41. The method of claim 39, wherein said capacitance is placed between points of lowest current in said loops.

42. The method of claim 39, further comprising varying the capacitance of said capacitor to tune said antenna.

* * * * *